US010249411B2

(12) United States Patent
Kunz et al.

(10) Patent No.: US 10,249,411 B2
(45) Date of Patent: Apr. 2, 2019

(54) CABLE WITH STRANDED WIRE PAIRS

(71) Applicant: ROSENBERGER HOCHFREQUENZTECHNIK GMBH & CO. KG, Fridolfing (DE)

(72) Inventors: Stephan Kunz, Chieming (DE); Gunnar Armbrecht, Mühldorf am Inn (DE); Thomas Lödding, Traunstein (DE)

(73) Assignee: Rosenbergerhochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/531,142

(22) PCT Filed: Nov. 26, 2015

(86) PCT No.: PCT/EP2015/002384
§ 371 (c)(1),
(2) Date: May 26, 2017

(87) PCT Pub. No.: WO2016/082935
PCT Pub. Date: Jun. 2, 2016

(65) Prior Publication Data

US 2017/0330651 A1 Nov. 16, 2017

(30) Foreign Application Priority Data

Nov. 28, 2014 (DE) ..... 20 2014 009 498 U

(51) Int. Cl.
*H01B 7/00* (2006.01)
*H01B 11/00* (2006.01)
*H01B 11/20* (2006.01)
*H01B 11/18* (2006.01)
*H01B 11/06* (2006.01)

(52) U.S. Cl.
CPC ..... *H01B 11/002* (2013.01); *H01B 11/1821* (2013.01); *H01B 11/20* (2013.01); *H01B 11/06* (2013.01)

(58) Field of Classification Search
CPC ... H01B 7/02; H01B 7/04; H01B 9/02; H01B 9/04; H01B 11/02; H01B 11/04
USPC ..... 174/102 R, 108, 109, 110 R, 113 R, 174/113 C
See application file for complete search history.

(56) References Cited

U.S. PATENT DOCUMENTS 6,452,107 B1 9/2002 Kebabjian
7,304,241 B2 * 12/2007 Trieb ..... H01R 9/032 174/74 R (Continued)

FOREIGN PATENT DOCUMENTS

CN 1529320 A 9/2004
CN 102318014 A 1/2012

(Continued)

*Primary Examiner* — William H Mayo, III
(74) *Attorney, Agent, or Firm* — Robert Curcio; DeLio, Peterson & Curcio, LLC

(57) ABSTRACT

A USB cable having at least two pairs of strands, each pair designed to transmit a differential data signal in the longitudinal direction (L) of the cable, the strands extending helically about a common braiding center such that at least one additional wire pair does not have a separate shield, wherein the wires of the additional wire pair are arranged at a distance from one another on opposite sides of the stranding center.

23 Claims, 6 Drawing Sheets

(56) References Cited

U.S. PATENT DOCUMENTS

| | | | | |
|---|---|---|---|---|
| 7,918,685 | B1 * | 4/2011 | Kruckenberg | H01B 11/00 174/75 C |
| 9,244,240 | B2 * | 1/2016 | Hayashishita | G02B 6/4434 |
| 9,349,508 | B2 * | 5/2016 | Nonen | H01B 11/20 |
| 9,508,467 | B2 * | 11/2016 | Pon | H01B 9/003 |
| 2003/0121694 | A1 * | 7/2003 | Grogl | H01B 3/441 174/113 R |
| 2005/0061536 | A1 * | 3/2005 | Proulx | G06Q 10/08 174/102 R |
| 2010/0051318 | A1 * | 3/2010 | Wang | H01B 11/12 174/113 R |
| 2010/0084157 | A1 * | 4/2010 | Wang | H01B 11/12 174/107 |
| 2010/0258333 | A1 * | 10/2010 | Horan | H01B 11/1091 174/78 |
| 2011/0162866 | A1 * | 7/2011 | Masakazu | H01B 11/002 174/103 |
| 2011/0278043 | A1 * | 11/2011 | Ueda | H01B 7/1895 174/115 |
| 2012/0103651 | A1 * | 5/2012 | Kim | H01B 11/1808 174/102 R |
| 2014/0216781 | A1 | 8/2014 | Shen | |
| 2016/0079689 | A1 * | 3/2016 | Wu | B23K 1/0016 439/581 |
| 2016/0079714 | A1 * | 3/2016 | Wu | H01R 13/6585 439/607.05 |

FOREIGN PATENT DOCUMENTS

| | | | |
|---|---|---|---|
| JP | 20080164000 | A | 1/2008 |
| WO | 2013033950 | A1 | 3/2013 |
| WO | 2013080103 | A1 | 6/2013 |

* cited by examiner

CABLE WITH STRANDED WIRE PAIRS

BACKGROUND OF THE INVENTION

1. Field of the Invention

The invention relates to a cable with at least two wire pairs which are in each case configured for the transmission of a differential data signal. In particular, the invention relates to a USB cable, for example a USB 3.0 cable or a USB 3.1 cable.

2. Description of Related Art

The transmission of USB signals is necessary for an extremely wide range of technical applications. For example, a USB socket may be desired in a rear part of a vehicle in order to allow USB devices to be plugged in, which means that a USB cable needs to be led through the vehicle from the front to the rear. USB sockets or USB connections can also be required in different locations (offices, public institutions, means of transport etc.) for the connection of USB devices, whereby USB cables need to be laid for this purpose.

Conventional USB2 interfaces (for example USB 2.0 interfaces) only have one signal wire pair (D+ and D−) and a wire pair for power supply (GND, VBUS). The data transmission takes place symmetrically via the signal wire pair, the data signal ("signal part") being transmitted through one wire of the signal wire pair and the corresponding inverted data signal ("reference part") being transmitted through the other wire. For this purpose, a cable for the transmission of USB2 signals uses two twisted and shielded wires as the signal conductor pair in order to minimize interference with transmission. The receiver of the signal determines the differential voltage of the data signal transmitted differentially via the signal wire pair, so that interference signals acting to an equal extent on both wires of the signal wire pair are eliminated.

A few years ago, the USB3 standard was introduced. USB3 interfaces (for example USB3.0 interfaces) have, in addition to the connections explained above (D+, D−, GND, VBUS) at least two additional signal wire pairs (SSTX+ and SSTX−; SSRX+ and SSRX−). A differential data signal is transmitted via each of these two signal wire pairs. Overall, this allows higher data rates to be achieved than with the conventional USB2 standard.

A conventional USB 3.0 cable is illustrated in FIG. 2. It shows three twisted wire pairs (twisted pairs 112, 114, 116), each configured for transmission of a differential data signal. A ground conductor in the form of a drain wire 115 can in each case be provided adjacent to the twisted wire pairs. In addition, two (untwisted) wires 122, 124 are provided for the power supply. The individual wire pairs are in each case surrounded by a foil shield, and all the wires are surrounded by a common shield 130 and a protective sheath 150. In addition, filler elements 140 can be provided in order to ensure that the cable is round in cross section.

It has been found that, in such a conventional wire arrangement, depending on the path of and distance between the wire pairs in the cable, a crosstalk of varying intensity can occur between the individual wire pairs. Moreover, a conventional USB 3.0 cable is comparatively thick, which makes simple and space-saving installation difficult.

Known from WO 2013/033950 A1 and U.S. Pat. No. 6,452,107 B1 are cables with at least two wire pairs for the transmission of a differential data signal, wherein the at least two wire pairs extend in the longitudinal direction of the cable in a helical arrangement around a common stranding center.

SUMMARY OF THE INVENTION

In view of the problems described, it is the object of the present invention to make a cable of the type described above more compact and at the same time guarantee a satisfactory protection against external interference and interference caused by adjacent wire pairs.

According to the invention, this object is solved by means of a cable according to the independent. Advantageous further developments of the invention are described in the dependent claims. In the cable according to the invention, the at least two wire pairs extend in the longitudinal direction of the cable in a helical arrangement around a common stranding center.

In other words, the individual wires of a wire pair are not in each case twisted together; rather, the wire pairs are stranded together around a common stranding center. Also, due to the stranding according to the invention, the mutual paths of the individual wire pairs and the distance from the adjacent wire pairs along the cable are in each case predetermined, so that a predictable, constant crosstalk level per cable unit length can be expected. Moreover, due to the orderly path of the individual wire pairs around the stranding center, the cable can be made more compact and thus also thinner and more space-saving than conventional cables, as a result of which the effort involved in installation and the transport costs can be reduced.

The above and other objects, which will be apparent to those skilled in the art, are achieved in the present invention which is directed to a cable with at least two wire pairs which are in each case configured for the transmission of a differential data signal, in particular USB cables, wherein the at least two wire pairs extend in the longitudinal direction of the cable (L) in a helical arrangement around a common stranding center, such that at least one additional wire pair does not have a separate shield, wherein the wires of the additional wire pair are arranged at a distance from one another, in particular on opposite sides of the stranding center.

The cable may have three wire pairs extending in a helical arrangement around the common stranding center, wherein the cable is a USB 3 cable.

The common stranding center may further comprise an additional wire, running in the center of the cable. The additional wire has a conductor with a greater cross-sectional area than the conductors of the wire pairs, and the cross-sectional area of the conductor of the additional wire may be greater than 0.5 $mm^2$ and less than 1 $mm^2$.

The cable may also include a common grounded shield surrounding all the wire pairs, which preferably forms the ground conductor of the USB cable.

The lay length of the helical arrangement of the wire pairs is preferably greater than 40 mm and is less than 120 mm, or greater than 60 mm and less than 100 mm.

In cross-sectional planes running through the cable, the distance between wires of a wire pair is in each case less than the distance between adjacent wire pairs.

At least two wire pairs each have a separate shield. On the one hand two wire pairs and on the other hand the two wires of the additional wire pair are arranged on opposite sides of the stranding center, wherein the wires of the additional wire pair are arranged adjacent to a common grounded shield.

In cross-sectional planes running through the cable, the individual wires of the wire pairs are each arranged at substantially the same distance from the stranding center. The wire pairs may also be arranged in a substantially rotationally symmetrical manner in relation to the stranding center, each being arranged on sides of an equilateral triangle or of a square which encloses the stranding center.

The cable may include filler elements extending in a rope-like manner in the longitudinal direction (L) of the cable which extend, together with the wire pairs, in a helical arrangement around the common stranding center at a specified distance between the wire pairs.

In cross-sectional planes running through the cable, three wire pairs and a pair of filler elements lie on four sides of a square and are stranded around the common stranding center.

The cable may include a filler element, extending in a rope-like manner in the longitudinal direction (L) of the cable, which, together with the wire pairs, extends in a helical arrangement around the common stranding center, which ensures a specified distance between the wire pairs and which is molded onto the stranding center.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-5 of the drawings in which like numerals refer to like features of the invention.

According to the invention, at least two wire pairs of the cable, in the case of a USB 3 cable the two Super Speed pairs have a separate shield, but at least a third wire pair of the cable, in the case of a USB 3 High Speed pair D+, D− has no separate shield. In this latter case, it is advantageous if the wires of the third wire pair are arranged within the cable at a good distance from one another, preferably on opposite sides of the stranding center. In particular, it is in this latter case advantageous if the two wires of the third wire pair are arranged adjacent to the common shield surrounding all the wire pairs, so that a maximum coupling of these wires to the grounded "common" shield is ensured. In this case one can speak of a "quasi ground-referenced transmission via the third wire pair, with good decoupling from the current-carrying wire running down the center of the cable, since the electrical field emanating from the wires of the third wire pair is in each case oriented towards the nearby common shield, not in the direction of the center of the cable in which the current-carrying wire runs.

Figure 2:
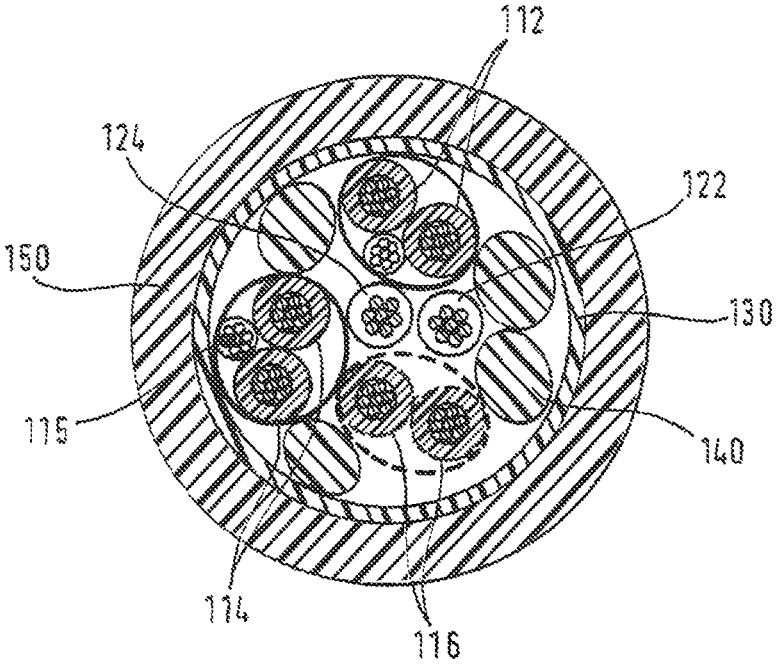
Fig. 2 ( PRIOR ART )
FIG. 2 shows a sectional view of a conventional USB 3.0 cable.

Compared with conventional cables with comparable inner conductor or wire cross sections, for example a USB 3.x cable, as illustrated in FIG. 2, the arrangement of the wire pairs according to the invention makes it possible to reduce the cable diameter by around 20% to around 40%, in particular by around 30%. For example, conventional USB 3 cables with comparable wire cross sections have a cable diameter of between 7 mm and 8 mm. In contrast, a USB 3 cable according to the invention has a cable diameter of between 5 and 6 mm, in particular around 5.5 mm.

Preferably, the cable according to the invention has exactly three wire pairs extending in a helical arrangement around the common stranding center. If the cable is a USB 3.x cable, the three wire pairs represent the conductor pairs SSTX+ and SSTX−; SSRX+ and SSRX−; D+ and D− described above. Alternatively, four and more wire pairs, in each case configured for the transmission of a differential signal, are also possible.

In order to achieve a particularly compact design of the cable it has proved advantageous for the common stranding center to comprise an additional wire, preferably running in the center of the cable, in particular the current-carrying wire (VBUS) of the USB cable. By having a stranding center in the form of an additional wire running along the center of the cable, around which the wire pairs extend in a helical arrangement, a desired roundness of the cable can also be ensured by simple means, without numerous filler elements being necessary.

Preferably, the additional wire has a conductor with a greater cross-sectional area than the conductors of the differential wire pairs. On the one hand, this can facilitate the manufacture of the stranding around the additional wire. For example, the cross-sectional area of the additional wire can be increased depending on the number of wire pairs which are to be stranded around it. Also, higher current strengths or higher electrical powers can be conducted via a wire with a larger conductor cross section. The conductor diameter of the individual wires of the wire pairs are preferably less than half as large as the conductor diameter of the additional wire.

In order to allow the possibly necessary high current strengths of 2 A and more which are for example required for the rapid charging of mobile devices via the USB port, it has proved expedient if the cross-sectional area of the conductor of the additional wire is greater than 0.5 $mm^2$ and less than 1.5 $mm^2$, in particular around 0.75 $mm^2$. In particular where the cable according to the invention is used in the automotive applications, the laying of additional power cables in addition to the USB cable can be dispensed with in this case, since high electrical powers can already be conducted via the cable according to the invention.

Preferably, the conductor of the additional wire comprises ten or more, in particular 15 or more copper wires with a diameter of in each case less than 0.5 mm, in particular less than 0.25 mm. The insulation of the additional wire can consist of a "poor" material, in terms of HF technology, that is to say of a material with a high dissipation factor or high attenuation. For example, the insulation of the additional wire is a PVC insulation. In this way, the propagation of interference within the cable, which can for example lead to an increased coupling between the SSTX/SSRX-wire pairs, can be additionally suppressed.

USB cables generally have a shield, for example in the form of a braided shield. Preferably, such a common shield surrounding all the wire pairs is also provided in the cable according to the invention. This shield is preferably grounded and particularly preferably forms the ground conductor (GND) of the cable. This means that the ground conductor (reference number 124 in FIG. 2) present in conventional USB cables in the form of an additional wire can be dispensed with in the cable. In other words, the shield which is in any case present forms the ground conductor, as a result of which the compactness of the cable can be further improved while at the same time maintaining the shield effect. In particular, in this case it is possible to design the stranding center in the form of a single wire, namely the current-carrying wire of the USB cable, which makes the manufacture of the stranded cable simpler because no other interference-generating wires are present.

In order to achieve an effective suppression of external interference it has proved expedient if the lay length of the helical arrangement of the individual wire pairs is greater than 40 mm and less than 120 mm, preferably greater than 60 mm and less than 100 mm, in particular around 80 mm. The lay length is the length of the distance in the longitudinal direction of the cable which a wire pair requires in order to wind around the stranding center by 360°.

At the same time, preferably in (all) the cross-sectional planes running through the cable, the distance between the wires of a wire pair is less than the distance between adjacent wire pairs. In particular, the two wires of at least two wire pairs lie directly adjacent to one another, while they maintain a distance from the next-nearest wire pair. For this purpose, spacer elements can be provided between the individual wire pairs, wherein the spacer elements can be stranded around the common stranding center together with the wire pairs. As a result, the individual wire pairs run through the cable in a particularly orderly and compact arrangement.

In an alternative embodiment of the invention, the two wires of at least two wire pairs are in each case arranged adjacent to one another, while the two wires of at least a third wire pair are arranged at a distance from one another. For example, the two wires of the third wire pair are arranged on opposite sides of the stranding center and/or are in each case offset by around 90° in relation to the two other wire pairs. Preferably, the third wire pair is the High Speed wire pair (D+ and D−) of the USB cable, and the other two wire pairs are the Super Speed wire pairs (SSTX+ and SSTX−; SSRX+ and SSRX−) of the USB cable. The important thing is that the wires of the at least one third wire pair are also stranded around the common stranding center. Preferably, at least two wire pairs have a separate shield, preferably in the form of a foil shield enveloping the wire pair. In order to achieve a compact arrangement, the foil shields of the individual wire pairs can thereby in each case lie tangentially against the additional wire forming the stranding center.

In a particularly preferred embodiment of the invention the shields surrounding the wire pairs, for example the foil shields, in each case make electrical contact with aforementioned collective shield of the cable which surrounds all the wire pairs ("common shield"). If the common shield is grounded, this means that the individual wire pair shields are also grounded or at a common electrical level. It has thereby proved expedient if gaps in the foil shields resulting from the manufacturing process in each case point radially outwards and thus face the common shield. Furthermore, in this case ground conductors, for example drain wires, which in conventional cables are generally provided within the foil shields in addition to the two wires of the wire pair can be dispensed with.

It has also proved expedient if, in (all) the cross-sectional planes running through the cable, the individual wires of the wire pairs are each arranged at substantially the same distance from the stranding center. In other words, the centers of the individual wires of the wire pairs each lie on a circle around the stranding center.

The compactness of the cable can be further improved in that, in (all) the cross-sectional planes running through the cable, the wire pairs are arranged in a substantially rotationally symmetrical manner in relation to the stranding center. Particularly preferably, the wire pairs (or the centers of the wires of the wire pairs) in each case substantially lie on sides of an equilateral triangle or of a square which encloses the stranding center. In the case of an equilateral triangle, a maximum of three wire pairs are provided—one on each side of the triangle—and in the case of a square a maximum of four wire pairs are provided—one on each side of the square.

A specified distance between the individual wire pairs can be ensured through filler elements extending in a rope-like manner in the longitudinal direction of the cable which can extend, together with the wire pairs, in a helical arrangement around the common stranding center. Alternatively or additionally, the filler elements can be arranged in the cable such that, overall, a substantially circular cable cross section results. Alternatively or additionally, filler elements can be provided which have a cross section which substantially corresponds with the cross section of the wires of the wire pairs, so that not only wire pairs, but also pairs of filler elements can extend in a helical arrangement around the stranding center and, overall, form a rotationally symmetrical arrangement. For example, in cross-sectional planes running through the cable, three wire pairs and a pair of filler elements lie on the four sides of a square and are stranded around the common stranding center.

In a preferred embodiment, additional conductors run within the cable in addition to the wire pairs and the centrally arranged additional wire. These additional conductors can be provided for the transmission of data signals, control signals, electrical currents or the like, depending on requirements. The additional conductors do not necessarily run around the common stranding center in a helical arrangement; if necessary they can also follow a linear path. Alternatively or additionally, the additional conductors can be provided in place of the aforementioned rope-like filler elements and assume their position within the cable.

Preferably, in each cross-sectional plane of the cable, each wire pair can be assigned a straight line running through the stranding center and between the wires of the pair which does not intersect with the wires of the pair.

In a preferred embodiment, a filler element extends in a rope-like manner in the longitudinal direction of the cable which extends together with the wire pairs in a helical arrangement around the common stranding center, which ensures a specified distance between the wire pairs and which is molded onto the stranding center. This makes it possible to dispense with filler elements in the form of separate components such as separate filler elements and in this way simplifies the manufacture of the cable as well as the logistics associated with its manufacture. The molded filler element can be formed of the material used for the insulation which clads the wire of the stranding center. This means that the stranding center can be formed in a single piece with the integrally molded filler element and forms grooves or recesses in which wires and/or wire pairs are partially embedded.

In a preferred embodiment, two electrical conductors of a wire pair are clad with a common, electrically insulating sheath. This simplifies the manufacture of such a wire pair.

In a preferred embodiment, an electrical conductor of an individual wire is clad with an electrically insulating sheath with elliptical cross section. The individual wire can be one of two wires of an additional wire pair. This too makes it possible to dispense with filler elements and so simplifies the manufacture of the cable.

In the following description, the invention is described with reference to the attached drawings, which show details of the invention which are important to the invention and which are not explained in detail in the description.

Figure 1A:
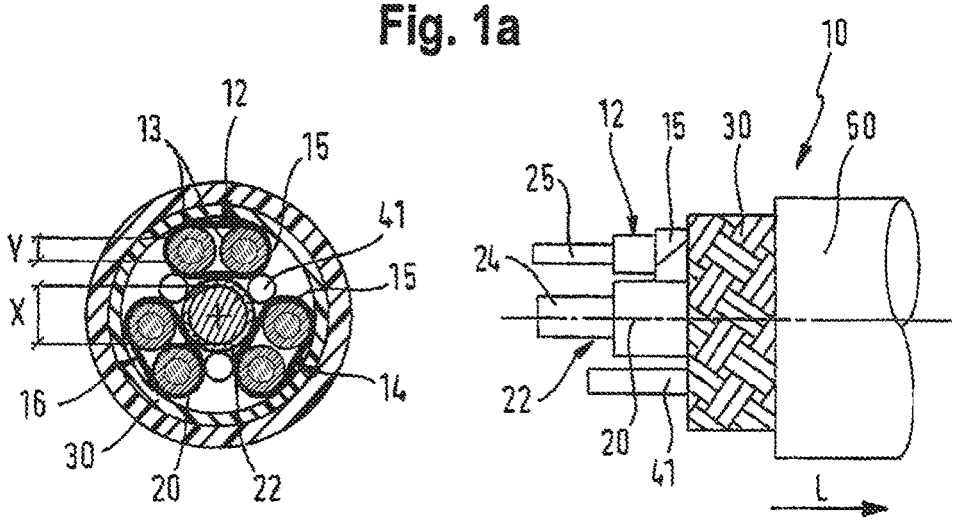
FIG. 1*a* shows a sectional view (left) and a side view (right) of a first embodiment of a cable according to the invention.

In FIG. 1*a*, a cross-sectional view of a first embodiment of the present invention is illustrated on the left and a longitudinal view of this embodiment is illustrated, in a partially cut-away side view, on the right. It shows a USB 3.x cable 10 with a total of three wire pairs 12, 14, 16, which are each configured for transmission of a differential data signal. Each wire pair has two adjacent wires 13 running next to one another and is surrounded by a separate shield 15, for example a foil shield.

The individual wires 13 consist of tinned copper wires, and have a conductor cross section of between 0.05 and 0.2 $mm^2$ and a PP insulation.

The wire pairs extend in the longitudinal direction L of the cable 10 in a helical arrangement around a common stranding center 20, wherein the stranding center is formed by an additional wire 22 with large conductor diameter X running in the center of the cable. In other words, the wires of the individual wire pairs are not twisted together; rather, the wire pairs are stranded together to form a single strand, which leads to a particularly compact and stable cable. The lay length of the stranding amounts to around 80 mm, wherein other lay lengths are possible depending on requirements and depending on the number of wire pairs and the diameter of the stranding center 20. The overall diameter of the cable lies between 5 mm and 6 mm. Comparable conventional USB cables have an overall diameter which is greater by around 20% to 40%.

The cross-sectional area of the conductor 24 of the additional wire 22 is around 0.75 $mm^2$, while the cross-sectional area of the conductors 25 of the wire pairs 12, 14, 16 is around 0.14 $mm^2$. This means that the diameter Y of the conductors 25 of the wire pairs is less than half as great as the diameter X of the conductor 24. The central additional wire 22 is configured for the transmission of high currents of more than 2 A. It forms the current-carrying wire of the USB cable.

The cable 10 also includes a common shield 30 surrounding all wires in the form of a braid made of tinned copper (Cu) wires which forms the ground conductor of the USB cable. An additional ground wire running in the interior of the cable can therefore be dispensed with. The foil shields 15 of the individual wire pairs make electrical contact with the common shield 30. Additional drain wires which run within the foil shields 15 are not thereby necessarily required.

As can clearly be seen in the cross-sectional view shown on the left, the three wire pairs 12, 14, 16 are arranged around the additional wire 22 in a substantially rotationally symmetrical manner, with a threefold rotational symmetry. In other words, the respective wire pairs enclose between them an angle of around 120° in relation to the stranding center 20. This rotationally symmetrical arrangement is ensured by means of filler elements 41 which are in each case arranged between the wire pairs 12, 14, 16 and also stranded around the stranding center 20.

The cable 10 is surrounded by a protective sheath 50 which can for example consist of PVC.

Figure 1B:
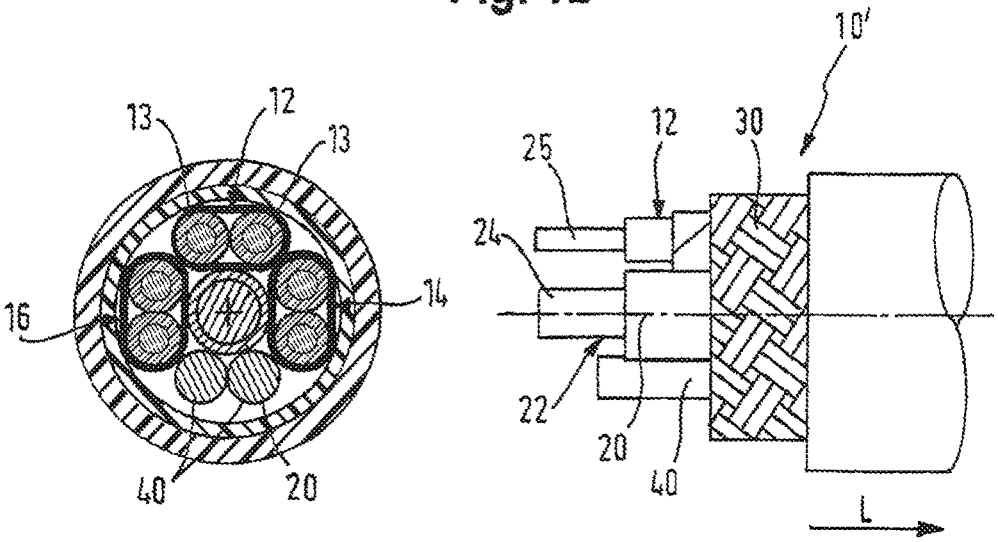
FIG. 1*b* shows a sectional view (left) and a side view (right) of a second embodiment of a cable according to the invention.

In FIG. 1*b*, a cross-sectional view of a second embodiment of the present invention is illustrated on the left and a longitudinal view of this embodiment is illustrated, in a partially cut-away side view, on the right. This cable 10' is also a USB cable (USB 3.x cable) with a total of three wire pairs 12, 14, 16 each intended for the transmission of a differential data signal. With the exception of the features described in the following, the cable 10' according to the second embodiment corresponds to the cable 10 according to the first embodiment, so that reference can be made to the remarks above.

The three wire pairs 12, 14, 16 also extend, in an arrangement which is substantially rotationally symmetrical in cross section, in a helical arrangement around the common stranding center 20, which is formed by the current-carrying wire 22. However, otherwise than in the first embodiment, the rotational symmetry is in this case fourfold, wherein a pair of filler elements 40 occupies the space of a (not present) fourth wire pair. In other words, in each cross-sectional plane the three wire pairs 12, 14, 16 and the pair of filler elements 40 in each case lie on a side of a square enclosing the stranding center 20. The diameter of the filler element 40 thereby corresponds substantially to the diameter of the wires 13 of the wire pairs 12, 14, 16.

In relation to the stranding center 20, the wire pairs in each case enclose between them an angle of around 90°.

Depending on requirements, further filler elements 40, 41 can be provided in order to ensure a specified mutual arrangement of the wire pairs 12, 14, 16 and/or in order to produce a round cable overall, without any indentations or the like. Instead of the (non-conductive) filler elements 40, 41, additional conductors can be provided within the cable which can be used for the transmission of data, signals, currents or the like. Alternatively or additionally, non-stranded conductors, for example linear additional conductors, can be provided within the cable.

Figure 3:
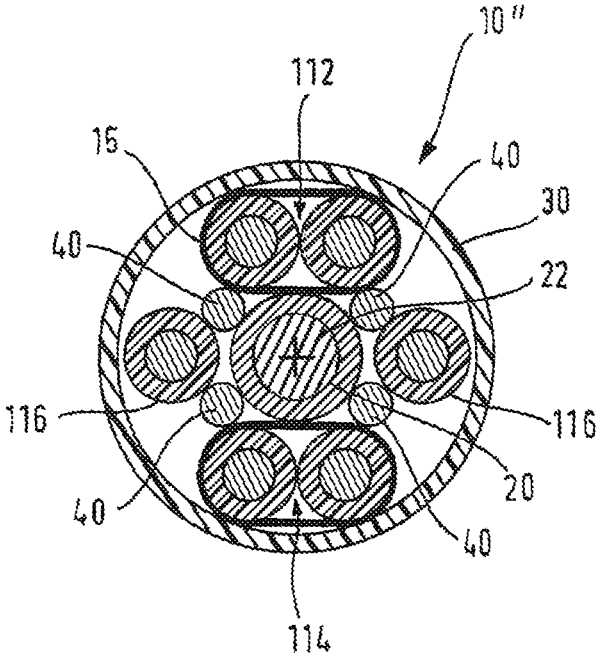
FIG. 3 shows a sectional view of a third embodiment of a cable according to the invention.

FIG. 3 illustrates a third embodiment of a USB 3.x cable 10" according to the invention in cross section. This cable 10" has two wire pairs 112, 114 (the two Super Speed pairs of the USB cable) which are in each case surrounded by a separate foil shield 15 which is in electrical contact with the common shield 30. These two wire pairs 112, 114 are arranged on opposite sides of the central current-carrying wire 22 and extend in a helical arrangement around the common stranding center 20, which is formed by the wire 22. The two wires of a third wire pair 116 (of the High Speed pair D+, D−) are arranged at a distance from one another within the cable, on opposite sides of the central current-carrying wire 22, in each case offset by around 90° relative to the two wire pairs 112, 114. The wires of the third wire pair 116 are also stranded around the stranding center 20 so that, apart from a rotation around the stranding center 20, the cable has the same arrangement of wires in any cross-sectional plane. The two wires of the third wire pair 116 are thereby arranged immediately adjacent to the grounded common shield 30, so that a quasi ground-referenced transmission results, practically without any coupling in the direction of the central current-carrying wire 22.

Overall, a substantially fourfold rotationally symmetrical arrangement of the wires around the stranding center 20 results, wherein on the one hand two wire pairs 112, 114 and on the other hand two individual wires of a third wire pair 116 lie opposite one another within the cable 10".

FIG. 3 also shows that in this embodiment four filler elements 40 are arranged between the stranding center 20 and the two wire pairs 112, 114 as well as the third wire pair 116.

It should also be noted that the common shield 30 comprises a braid of electrically conductive threads and/or wires and/or an electrically conductive foil.

Otherwise, reference is made to the features of the first and second embodiments of the invention described above, which can also be provided in the third embodiment.

Figure 4A:
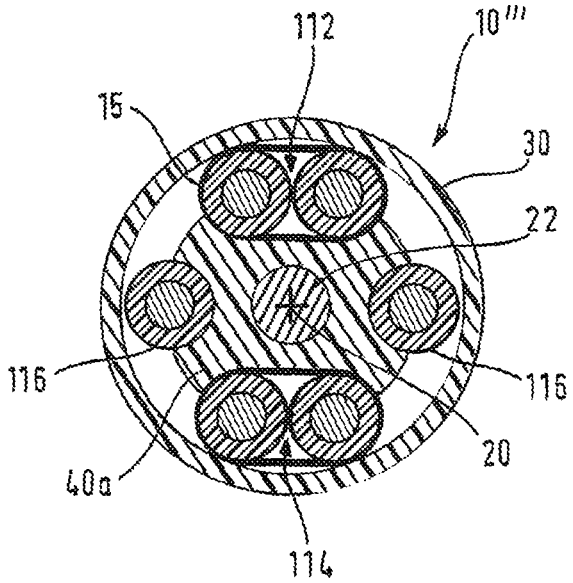
FIG. 4*a* shows a sectional view of a fourth embodiment of a cable according to the invention.

FIG. 4*a* illustrates in cross section a fourth embodiment of a USB 3.x cable 10' according to the invention which differs from the third embodiment in that the stranding center 20 has a filler element 40*a* molded onto it. The molded filler element 40*a* is in the present embodiment formed of the material of the insulation which clads the wire 22. Thus, in the fourth embodiment, the stranding center 20 is formed in a single piece with the filler element 40*a* molded thereon. The stranding center 20 with the molded filler element 40*a* also forms grooves or recesses in which the two wire pairs 112, 114 and the third wire pair 116 are at least partially embedded.

Otherwise, reference is made to the features of the first, second and third embodiments of the invention described above, which can also be provided in the fourth embodiment.

Figure 4B:
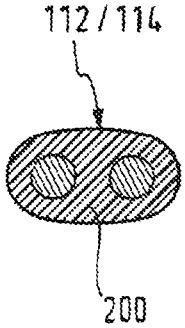
FIG. 4*b* shows a sectional view of a further embodiment of a wire pair of a cable according to the invention.

FIG. 4*b* illustrates a further embodiment of the two wire pairs 112, 114 which differs from the third embodiment in that the two electrical conductors of the two wire pairs 112, 114 are in each case surrounded by a common electrically insulating sheath 200.

Figure 5:
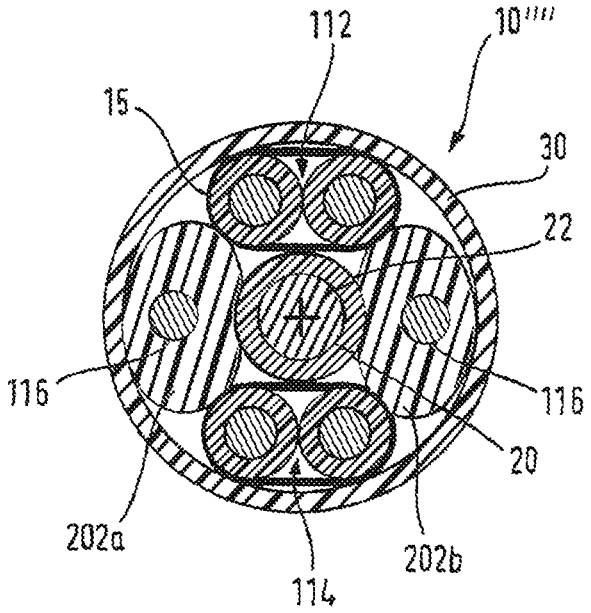
FIG. 5 shows a sectional view of a fifth embodiment of a cable according to the invention.

FIG. 5 illustrates in cross section a fifth embodiment of a USB 3.x cable 10'''' according to the invention which differs from the fourth embodiment in that the two sheaths 202*a*, 202*b* which in each case surround the two electrical conductors of the third wire pair 116 are elliptical in cross section.

In this embodiment, the stranding center 20 can have a circular cross section, as in the third embodiment shown in FIG. 3. Alternatively however, the stranding center 20 can also have filler elements 40*a* molded thereon, analogously to the fourth embodiment. Also, this fifth embodiment can have the embodiment of the two wire pairs 112, 114 shown in FIGS. 3 and 4*a* or the embodiment of the two wire pairs 112, 114 shown in FIG. 4*b*.

The invention is not limited to the described embodiments. In particular, the cable according to the invention is not necessarily a USB cable. Also, the cable according to the invention can also comprise only two or more than three stranded wire pairs. In order to ensure a rotationally symmetrical structure, more than one wire pair can be replaced with a pair of filler elements. Particularly important according to the invention is the stranding of the wire pairs around a common stranding center, wherein the stranding center is preferably formed by the centrally arranged current-carrying wire of a USB cable.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cable with at least two wire pairs which are in each case configured for the transmission of a differential data signal, in particular USB cables, wherein the at least two wire pairs extend in the longitudinal direction of the cable (L) in a helical arrangement around a common stranding center, such that at least one additional wire pair does not have a separate shield, wherein the wires of the additional wire pair each include a conductive core and insulation, and are arranged at a distance from one another on diagonal opposite sides of the stranding center.

2. The cable of claim 1, having three wire pairs extending in a helical arrangement around the common stranding center, wherein the cable is a USB 3 cable.

3. The cable of claim 1, wherein the common stranding center comprises an additional wire, running in the center of the cable.

4. The cable of claim 3, wherein the additional wire has a conductor with a greater cross-sectional area than the conductors of the wire pairs.

5. The cable of claim 3 wherein the cross-sectional area of the conductor of the additional wire is greater than 0.5 $mm^2$ and is less than 1 $mm^2$.

6. The cable of claim 5 wherein the cross-sectional area of the conductor of the additional wire is approximately 0.75 $mm^2$.

7. The cable of claim 3, wherein said additional wire is a current carrying wire of the USB cable.

8. The cable of claim 7, wherein said additional wire has a conductor with a greater cross-sectional area than the conductors of the wire pairs.

9. The cable of claim 1 including a common grounded shield surrounding all the wire pairs, which preferably forms the ground conductor of the USB cable.

10. The cable of claim 1 wherein the lay length of the helical arrangement of the wire pairs is greater than 40 mm and is less than 120 mm.

11. The cable of claim 10 wherein the lay length of the helical arrangement of the wire pairs is approximately 80 mm.

12. The cable of claim 1 wherein in cross-sectional planes running through the cable, the distance between wires of a wire pair is in each case less than the distance between adjacent wire pairs.

13. The cable of claim 12 wherein in cross-sectional planes running through the cable, the individual wires of the wire pairs are each arranged at substantially the same distance from the stranding center.

14. The cable of claim 13 wherein in the cross-sectional planes running through the cable, the wire pairs are arranged in a substantially rotationally symmetrical manner in relation to the stranding center, each being arranged on sides of an equilateral triangle or of a square which encloses the stranding center.

15. The cable of claim 14 wherein in cross-sectional planes running through the cable, three wire pairs and a pair of filler elements lie on four sides of a square and are stranded around the common stranding center.

16. The cable of claim 1 wherein at least two wire pairs each have a separate shield.

17. The cable of claim 16 wherein said separate shield is a foil shield enveloping each of said at least two wire pairs.

18. The cable of claim 1, wherein on the one hand two wire pairs and on the other hand the two wires of the additional wire pair are arranged on opposite sides of the stranding center, wherein the wires of the additional wire pair are arranged adjacent to a common grounded shield.

19. The cable of claim 1 including filler elements extending in a rope-like manner in the longitudinal direction (L) of the cable which extend, together with the wire pairs, in a helical arrangement around the common stranding center at a specified distance between the wire pairs.

20. The cable of claim 1 including a filler element, extending in a rope-like manner in the longitudinal direction (L) of the cable, which, together with the wire pairs, extends in a helical arrangement around the common stranding center, which ensures a specified distance between the wire pairs and which is molded onto the stranding center.

21. The cable of claim 1 including two electrical conductors of a wire pair which are clad with a common, electrically insulating sheath.

22. The cable of claim 1 including an electrical conductor of an individual wire which is clad with an electrically insulating sheath with elliptical cross section.

23. The cable of claim 1, wherein the lay length of the helical arrangement of the wire pairs is greater than 60 mm and less than 100 mm.

* * * * *